US009927767B2

(12) United States Patent
Itabashi et al.

(10) Patent No.: US 9,927,767 B2
(45) Date of Patent: Mar. 27, 2018

(54) DEVELOPING CARTRIDGE INCLUDING LOCK RIB POSITIONED AT END SURFACE OF CASING

(71) Applicant: BROTHER KOGYO KABUSHIKI KAISHA, Nagoya-shi, Aichi-ken (JP)

(72) Inventors: Nao Itabashi, Nagoya (JP); Hiroki Mori, Nagoya (JP); Shota Shinoya, Nisshin (JP); Hiromitsu Mizutani, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/467,680

(22) Filed: Mar. 23, 2017

(65) Prior Publication Data

US 2018/0004123 A1 Jan. 4, 2018

(30) Foreign Application Priority Data

Jun. 30, 2016 (JP) ..... 2016-130753

(51) Int. Cl.
*G03G 21/18* (2006.01)
*G03G 15/08* (2006.01)

(52) U.S. Cl.
CPC ..... *G03G 21/1821* (2013.01); *G03G 15/0889* (2013.01); *G03G 21/186* (2013.01); (Continued)

(58) Field of Classification Search
CPC ..... G03G 21/1817; G03G 21/1821; G03G 21/1857; G03G 21/186; G03G 21/1867; G03G 15/0889
See application file for complete search history.

(56) References Cited

U.S. PATENT DOCUMENTS

2005/0031359 A1 2/2005 Ishii
2011/0129252 A1 6/2011 Oda et al.
(Continued)

FOREIGN PATENT DOCUMENTS

JP 2013-054058 A 3/2013
JP 2013-73213 A 4/2013
(Continued)

OTHER PUBLICATIONS

Office Action issued in related German Patent application No. 10 2017 106 464,8, dated Nov. 15, 2017.

*Primary Examiner* — Rodney Bonnette
(74) *Attorney, Agent, or Firm* — Merchant & Gould P.C.

(57) ABSTRACT

A developing cartridge includes: a casing, a developing roller, a coupling, a coupling gear, a detection gear, an agitator, a first gear cover, a second gear cover, and a lock rib. The casing accommodates developing agent. The developing roller is rotatable about a first axis. The coupling and the coupling gear are rotatable about a second axis. The detection gear is rotatable about a third axis. The agitator agitates developing agent in the casing and performs power transmission from the coupling gear to the detection gear. The first gear cover covers at least the coupling gear. The second gear cover covers at least a portion of the detection gear. The lock rib is positioned at the other end of the casing. The lock rib is configured to be locked to a portion of a drum cartridge in a state where the developing cartridge is attached to the drum cartridge.

14 Claims, 12 Drawing Sheets

(52) U.S. Cl.
CPC ..... *G03G 21/1817* (2013.01); *G03G 21/1857* (2013.01); *G03G 21/1867* (2013.01)

(56) References Cited

U.S. PATENT DOCUMENTS

| | | | | |
|---|---|---|---|---|
| 2013/0051815 | A1* | 2/2013 | Itabashi | G03G 21/1857 399/12 |
| 2013/0051849 | A1* | 2/2013 | Itabashi | G03G 21/1821 399/111 |
| 2013/0084081 | A1 | 4/2013 | Itabashi et al. | |
| 2014/0092197 | A1 | 4/2014 | Aoi | |
| 2016/0054702 | A1 | 2/2016 | Itabashi | |
| 2017/0185001 | A1* | 6/2017 | Itabashi | G03G 15/0867 |

FOREIGN PATENT DOCUMENTS

| | | | |
|---|---|---|---|
| JP | 2014-71219 | A | 4/2014 |
| WO | 2016-125209 | A1 | 8/2016 |

* cited by examiner

DEVELOPING CARTRIDGE INCLUDING LOCK RIB POSITIONED AT END SURFACE OF CASING

CROSS REFERENCE TO RELATED APPLICATION

This application claims priority from Japanese Patent Application No. 2016-130753 filed Jun. 30, 2016. The entire content of the priority application is incorporated herein by reference.

TECHNICAL FIELD

The present disclosure relates to a developing cartridge.

BACKGROUND

An electro-photographic type image forming apparatus such as a laser printer and an LED printer is known in the art. The image forming apparatus uses a developing cartridge.

Prior art discloses a conventional developing cartridge configured to be attached to a drum cartridge. The drum cartridge includes a lock lever. The developing cartridge includes a coupling and a lock rib configured to be engaged with the lock lever in a case where the developing cartridge is attached to the drum cartridge. With this configuration, the developing cartridge is locked relative to the drum cartridge at its attached position. A rotational driving force is applied to the coupling.

SUMMARY

In the developing cartridge disclosed in the prior art, both of the coupling and the lock rib are provided at one end surface of a frame of the developing cartridge. Therefore, if the frame of the developing cartridge is displaced toward another end surface of the frame in a case where the coupling is pressed due to input of the driving force to the coupling, the lock rib may be displaced relative to the lock lever in a direction away from the lock lever. Accordingly, a sufficient engagement area between the lock lever and the lock rib is required for stabilization of engagement between the lock lever and the lock rib.

It is therefore an object of the disclosure to provide a developing cartridge capable of maintaining engagement of the lock rib with a portion of the drum cartridge.

In order to attain the above and other objects, the disclosure provides a developing cartridge including: a casing, a developing roller, a coupling, a coupling gear, a detection gear, an agitator, a first gear cover, a second gear cover, and a lock rib. The casing is configured to accommodate developing agent. The developing roller is rotatable about a first axis extending in a first direction. The developing roller is positioned at one end portion of the casing in a second direction crossing the first direction. The coupling is positioned at one end of the casing in the first direction and rotatable about a second axis extending in the first direction. The coupling gear is rotatable about the second axis extending in the first direction together with the coupling. The detection gear is positioned at another end of the casing in the first direction. The detection gear is rotatable about a third axis extending in the first direction. The agitator is configured to agitate developing agent in the casing and configured to perform power transmission from the coupling gear to the detection gear. The first gear cover covers at least the coupling gear. The second gear cover covers at least a portion of the detection gear. The lock rib is positioned at the other end of the casing in the first direction and positioned opposite to the developing roller with respect to the detection gear in the second direction. The lock rib is configured to be locked to a portion of a drum cartridge in a state where the developing cartridge is attached to the drum cartridge.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge according to one embodiment will be described with reference to FIGS. 1 through 7.

1. Overall Structure of Developing Cartridge

Figure 1:
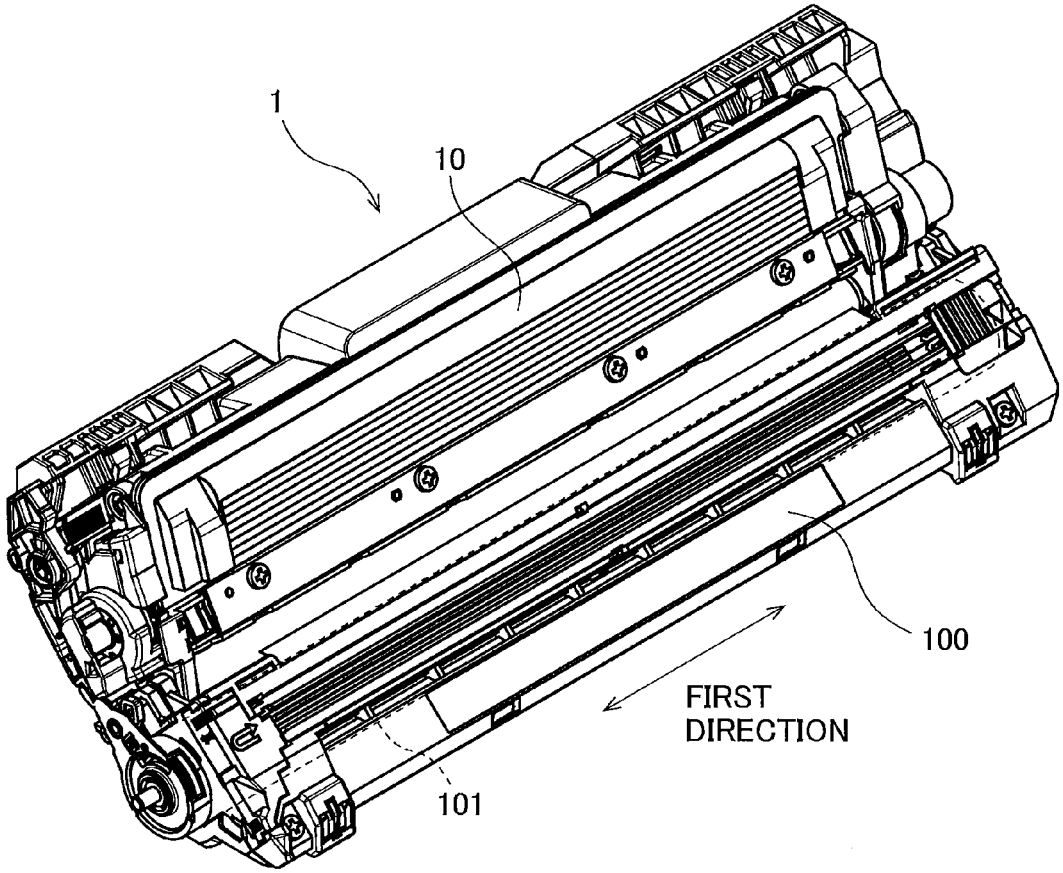
FIG. 1 is a perspective view of a drum cartridge and a developing cartridge according to one embodiment, and illustrating a state where the developing cartridge has been attached to the drum cartridge.
Figure 2:
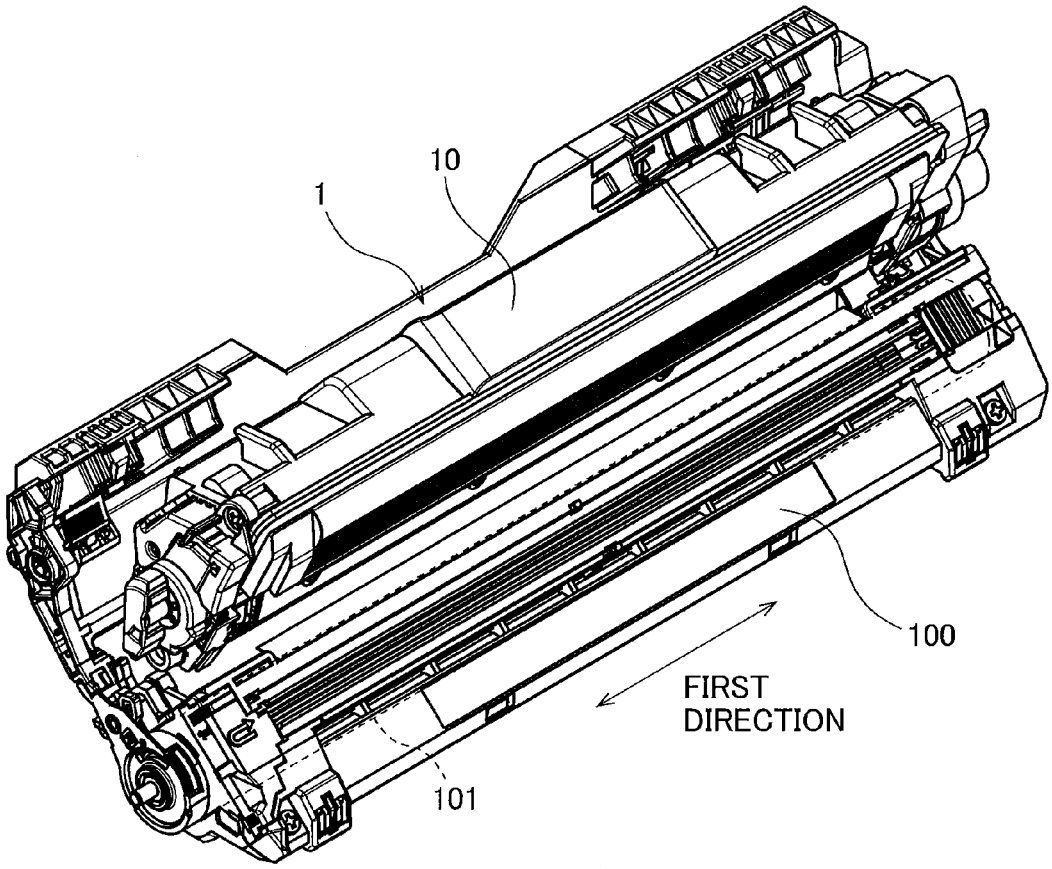
FIG. 2 is a perspective view of the drum cartridge and the developing cartridge according to the embodiment, and illustrating a state where the developing cartridge is detached from the drum cartridge.

FIG. 1 is a perspective view of a drum cartridge 100 and a developing cartridge 1 attached to the drum cartridge 100. FIG. 2 is a perspective view of the drum cartridge 100 and the developing cartridge 1 detached from the drum cartridge 100. The drum cartridge 100 and the developing cartridge 1 are used for an electro-photographic type image forming apparatus such as a laser printer and an LED printer. The developing cartridge 1 is attached to the drum cartridge 100, and the drum cartridge 100 to which the developing cartridge 1 is attached is accommodated in the image forming apparatus. The drum cartridge 100 includes a photosensitive drum 101. The developing cartridge 1 is configured to supply developing agent such as toner to the photosensitive drum 101.

Figure 3:
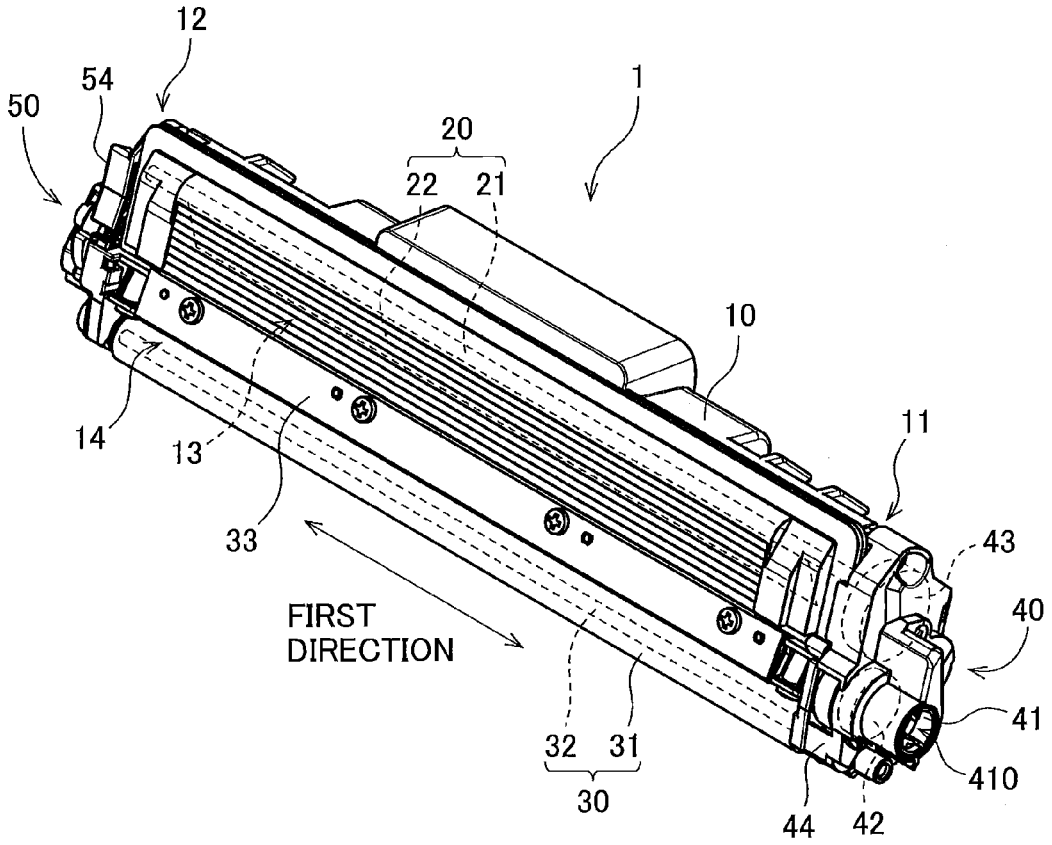
FIG. 3 is a perspective view of the developing cartridge according to the embodiment.
Figure 4:
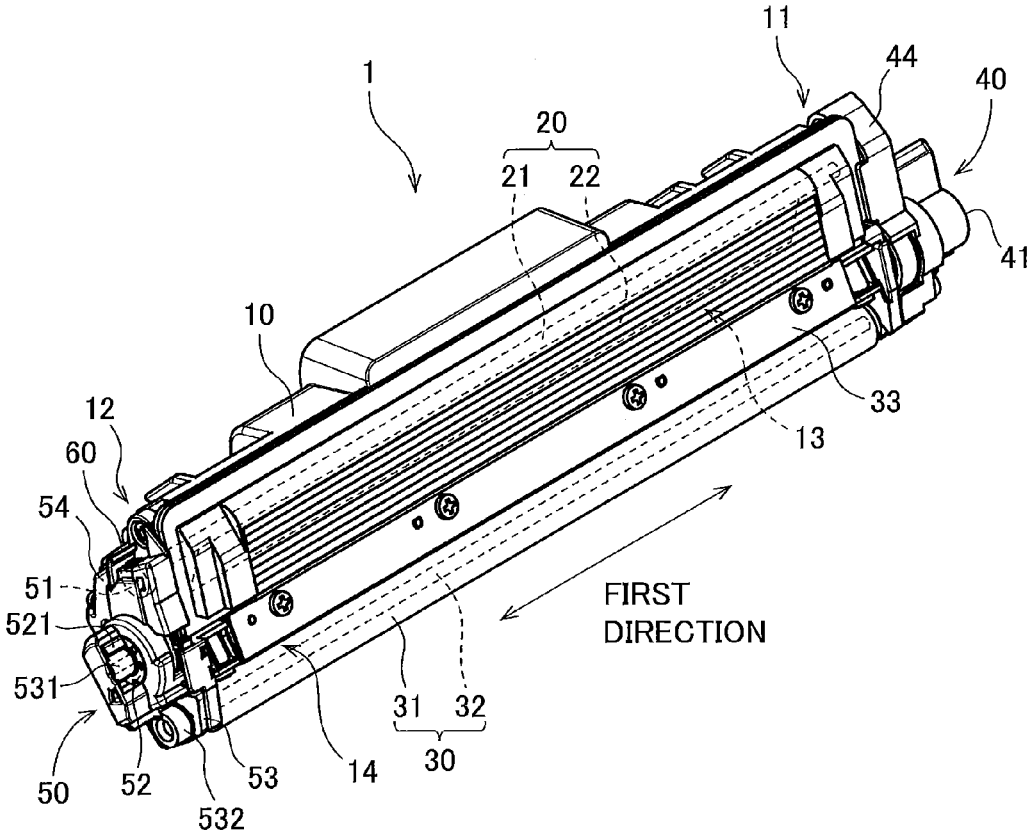
FIG. 4 is another perspective view of the developing cartridge according to the embodiment.

FIGS. 3 and 4 are perspective views of the developing cartridge 1. As illustrated in FIGS. 3 and 4, the developing cartridge 1 includes a casing 10, an agitator 20, a developing roller 30, a first gear portion 40, and a second gear portion 50.

Incidentally, an extending direction of a rotational axis of the developing roller 30 will be referred to as "first direction", and a direction of an array of the developing roller 30 and the agitator 20 will be referred to as "second direction". The first direction and the second direction are crossing each other (perpendicular to each other in the present embodiment).

The casing 10 is a container configured to accommodate developing agent, and has a first end surface 11 and a second end surface 12. The casing 10 extends in the first direction between the first end surface 11 and the second end surface 1 That is, the first end surface 11 is one end of the casing 10 in the first direction, and the second end surface 12 is another end of the casing 10 in the first direction. The first gear portion 40 is positioned at the first end surface 11, and the second gear portion 50 is positioned at the second end surface 12. An interior of the casing 10 includes an accommodation chamber 13 in which developing agent is accommodated. The casing 10 has an opening portion 14. The opening portion 14 is positioned at one end portion of the casing 10 in the second direction. The accommodation chamber 13 and an outside of the casing 10 are in communication with each other through the opening portion 14.

The agitator 20 is rotatable about a rotational axis (an example of a fourth axis) extending in the first direction. The agitator 20 includes an agitator shaft 21 and an agitation blade 22. The agitator shaft 21 extends in the first direction. The agitation blade 22 extends radially outward from the agitator shaft 21. At least a portion of the agitator shaft 21 and the agitation blade 22 are positioned in the accommodation chamber 13. The agitator shaft 21 has one end portion and the other end portion in the first direction. A first agitator gear 43 (described later) is mounted to the one end portion of the agitator shaft 21, and a second agitator gear 51 (described later) is mounted to the other end portion of the agitator shaft 21. Specifically, the first agitator gear 43 and the second agitator gear 51 are fixed to the agitator shaft 21 so as not to rotate relative to the agitator shaft 21. Thus, the agitator shaft 21 and the agitation blade 22 are rotatable together with the first agitator gear 43 and the second agitator gear 51. Upon rotation of the agitation blade 22, developing agent in the accommodation chamber 13 is agitated.

The developing roller 30 is rotatable about the rotational axis (an example of a first axis) extending in the first direction. The developing roller 30 is positioned at the opening portion 14 of the casing 10. The developing roller 30 includes a roller body 31 and a developing roller shaft 32. The roller body 31 has a hollow cylindrical shape extending in the first direction and is made of a material having elasticity such as rubber. The developing roller shaft 32 has a solid cylindrical shape extending through the roller body 31 in the first direction. The developing roller shaft 32 is made of metal or resin that has electrical conductivity. The roller body 31 is fixed to the developing roller shaft 32 so as to not to rotate relative to the developing roller shaft 32.

The developing roller shaft 32 has one end portion in the first direction to which a gear of the first gear portion 40 is fixed. Thus, the developing roller shaft 32 is rotated upon rotation of the gear of the first gear portion 40, whereby the roller body 31 is also rotated together with the developing roller shaft 32.

Incidentally, the developing roller shaft 32 may not extend through the roller body 31 in the first direction. For example, each of a pair of developing roller shafts 32 may extend in the first direction from each end portion of the roller body 31 in the first direction. Further, the developing roller shaft 32 may be a hollow shaft.

The developing cartridge 1 further includes a supply roller (not illustrated) positioned between the developing roller 30 and the accommodation chamber 13. The supply roller is rotatable about a rotational axis extending in the first direction. In a case where driving force is applied to the developing cartridge 1, developing agent is supplied from the accommodation chamber 13 of the casing 10 to an outer circumferential surface of the developing roller 30 (i.e., outer circumferential surface of the roller body 31) through the supply roller. In this instance, developing agent is triboelectric charged between the supply roller and the developing roller 30. On the other hand, bias voltage is applied to the developing roller shaft 32 of the developing roller 30. Accordingly, developing agent is attracted to the outer circumferential surface of the roller body 31 by electrostatic force generated between the developing roller shaft 32 and the developing agent.

The developing cartridge 1 further includes a layer thickness regulation blade 33. The layer thickness regulation blade 33 is configured to regulate a thickness of a layer of developing agent supplied to the outer circumferential surface of the roller body 31 so that the thickness of the layer of developing agent is formed to a constant thickness. Then, developing agent on the outer circumferential surface of the roller body 31 is supplied to the photosensitive drum 101 provided in the drum cartridge 100. In this case, developing agent is moved from the roller body 31 to the photosensitive drum 101 in accordance with an electrostatic latent image formed on an outer circumferential surface of the photosensitive drum 101. Thus, the electrostatic latent image on the outer circumferential surface of the photosensitive drum 101 becomes a visible image.

The first gear portion 40 is positioned at the first end surface 11 of the casing 10. The first gear portion 40 includes a coupling 41, a coupling gear 42, the first agitator gear 43, and a first gear cover 44. Incidentally, the first gear portion 40 may include an additional gear(s).

The coupling 41 is configured to first receive driving force supplied from the image forming apparatus. The coupling 41 has a coupling hole 410 recessed in the first direction. In a case where the drum cartridge 100 to which the developing cartridge 1 is attached is installed in the image forming apparatus, a drive shaft (not illustrated) of the image forming apparatus is inserted into the coupling hole 410 of the coupling 41. Thus, the drive shaft of the image forming apparatus and the coupling 41 are coupled with each other so that relative rotation between the drive shaft and the coupling 41 is prevented. Accordingly, upon rotation of the drive shaft, the coupling 41 is also rotated about a rotational axis (an example of a second axis) extending in the first direction.

The coupling gear 42 is rotatable together with the coupling 41. A plurality of gear teeth are provided over an entire outer circumferential surface of the coupling gear 42. The plurality of gear teeth are spaced away from each other at a constant interval in a circumferential direction of the coupling gear 42. In the present embodiment, the coupling 41 and the coupling gear 42 are formed of resin, and integrally configured with each other. Thus, upon rotation of the coupling 41, the coupling gear 42 is also rotated about the rotational axis (an example of the second axis) extending in the first direction. Incidentally, the coupling 41 and the coupling gear 42 may be configured as separated components and fixed to each other.

The first agitator gear 43 is configured to rotate the agitator 20 provided in the accommodation chamber 13, and is rotatable about the rotational axis (an example of the fourth axis) extending in the first direction. A plurality of gear teeth are provided over an entire outer circumferential surface of the first agitator gear 43. The plurality of gear teeth are spaced away from each other at a constant interval in a circumferential direction of the first agitator gear 43. A portion of the plurality of gear teeth of the coupling gear 42 and a portion of the plurality of gear teeth of the first agitator gear 43 are in meshing engagement with each other. Further, the first agitator gear 43 is fixed to the one end portion of the agitator shaft 21 in the first direction so as not to rotate relative to the agitator shaft 21. Therefore, the first agitator gear 43 is rotated upon rotation of the coupling gear 42, and the agitator 20 is also rotated together with the first agitator gear 43.

Note that an additional gear(s) may be provided between the coupling gear 42 and the first agitator gear 43. For example, the first gear portion 40 may include a first idle gear engaged with both the coupling gear 42 and the first agitator gear 43, and rotation of the coupling gear 42 may be transmitted to the first agitator gear 43 through the first idle gear.

The first gear cover 44 is fixed to the first end surface 11, for example, by screws. In other words, the first gear cover 44 is positioned at the first end surface 11. The coupling gear 42 and the first agitator gear 43 are accommodated in a space defined between the first end surface 11 and the first gear cover 44. That is, the coupling gear 42 and the first agitator gear 43 are covered by the first gear cover 44. The coupling hole 410 of the coupling 41 is exposed to an outside of the first gear cover 44.

The second gear portion 50 is positioned at the second end surface 12 of the casing 10. The second gear portion 50 includes the second agitator gear 51, a detection gear 52, an electrode 53, and a second gear cover 54. Incidentally, the second gear portion 50 may include an additional gear(s).

The second agitator gear 51 is configured to transmit rotation of the agitator shaft 21 to the detection gear 52. A plurality of gear teeth are provided over an entire outer circumferential surface of the second agitator gear 51. The plurality of gear teeth are spaced away from each other at a constant interval in a circumferential direction of the second agitator gear 51. The second agitator gear 51 is rotatable about the rotational axis (an example of the fourth axis) extending in the first direction. Further, the second agitator gear 51 is fixed to the other end portion of the agitator shaft 21 in the first direction so as not to rotate relative to the agitator shaft 21. Therefore, the second agitator gear 51 is rotated upon rotation of the agitator shaft 21.

The detection gear 52 is rotatable about a rotational axis (an example of a third axis) extending in the first direction. A portion of an outer circumferential surface of the detection gear 52 includes a plurality of gear teeth. In a case where the drum cartridge 100 to which a new developing cartridge 1 is attached is installed in the image forming apparatus, the coupling 41 receives driving force from the image forming apparatus. Then, the second agitator gear 51 is rotated by the driving force transmitted from the coupling 41 through the coupling gear 42, the first agitator gear 43, and the agitator 20. The detection gear 52 is rotated by meshing engagement with the second agitator gear 51. However, since the gear teeth are provided only at the portion of the outer circumferential surface of the detection gear 52, the detection gear 52 is disengaged from the second agitator gear 51 as a result of predetermined angular rotation of the detection gear 52, thereby stopping rotation of the detection gear 52.

That is, the developing cartridge 1 includes a power transmission mechanism for transmitting driving force from the coupling gear 42 to the detection gear 52. The agitator 20 is a part of the power transmission mechanism. That is, the agitator 20 is configured to perform power transmission from the coupling gear 42 to the detection gear 52. In a case where the detection gear 52 is rotated by a predetermined angle, the detection gear 52 is shut off from the power transmission mechanism. More specifically, the detection gear 52 is disconnected from the agitator 20 such that the power transmission through the agitator 20 to the detection gear 52 is shut off as a result of rotation of the detection gear 52 by a predetermined angle.

In this way in the image forming apparatus, the detection gear 52 and the second agitator gear 51 are in disengagement from each other with respect to the developing cartridge 1 that has been already used. Thus, in a case where the used developing cartridge 1 is detached from the image forming apparatus and is then re-attached to the image forming apparatus, rotation of the second agitator gear 51 is not transmitted to the detection gear 52, and accordingly, the detection gear 52 is not rotated.

With this configuration, in a case where the detection gear 52 is rotated, the developing cartridge 1 can be determined as a new cartridge. On the other hand, in a case where the detection gear 52 is not rotated, the developing cartridge 1 can be determined as a used cartridge.

Incidentally, an additional gear(s) may be positioned between the second agitator gear 51 and the detection gear 52. For example, the second gear portion 50 may further include a second idle gear engaged with both the second agitator gear 51 and the detection gear 52. In this case, rotation of the second agitator gear 51 is transmitted to the detection gear 52 through the second idle gear.

The detection gear 52 includes a detection protrusion 521 protruding in the first direction. The detection protrusion 521 is arcuate in shape about the rotation axis of the detection gear 52. The detection protrusion 521 is moved upon rotation of the detection gear 52. That is, a position of the detection protrusion 521 is changed in accordance with the rotation of the detection gear 52.

The detection gear 52 is configured to transmit information of the developing cartridge 1 to the image forming apparatus through the movement of the detection protrusion 521. Examples of the information of the developing cartridge 1 include information relating to whether the developing cartridge 1 is a new cartridge or a used cartridge, and information relating to specification of the developing cartridge 1. The specification of the developing cartridge 1 includes yield information relating to amount of developing agent contained in the developing cartridge 1 or yield information indicating printable numbers of sheets with developing agent.

The electrode 53 is electrically connected to the developing roller shaft 32 of the developing roller 30, and is made of an electrically conductive material such as metal or electrically conductive resin. The electrode 53 is positioned at the second end surface 12 of the casing 10, and includes a hollow cylindrical gear shaft 531 (an example of a shaft) protruding in the first direction. The detection gear 52 is rotatable about the gear shaft 531 while supported by the gear shaft 531. The detection protrusion 521 covers a portion of a peripheral surface of the gear shaft 531. The electrode 53 further includes a bearing 532 through which the developing roller shaft 32 is inserted. The bearing 532 is in contact with the developing roller shaft 32.

The image forming apparatus includes an electrically conductive detection lever (not illustrated) configured to contact the gear shaft 531, and an optical sensor (not illustrated). The electrode 53 and the developing roller shaft 32 are electrically connected to the detection lever when the gear shaft 531 is brought into contact with the detection lever. In driving state of the image forming apparatus, the developing roller shaft 32 is maintained at a predetermined bias voltage by electric power supplied through the detection lever.

The detection protrusion 521 covers a portion of the peripheral surface of the gear shaft 531. Therefore, during rotation of the detection gear 52, contacting state between the detection lever and the gear shaft 531 is changed dependent on a shape of the detection gear 52. That is, the detection lever is temporarily moved away from the gear shaft 531. The image forming apparatus detects the displacement of the detection lever by the optical sensor, so that a controller of the image forming apparatus identifies whether or not the attached developing cartridge 1 is a new cartridge, and also identifies specification of the developing cartridge 1 on the basis of the detection signal outputted from the optical sensor.

In this way, in the present embodiment, the optical sensor detects displacement of the detection protrusion 521 through the detection lever. However, the optical sensor may directly detect the movement of the detection protrusion 521. Further, a magnetic sensor or a contact type sensor may be used instead of the optical sensor. Further, the movement of the detection protrusion 521 may be detected on the basis of electric continuity between the detection lever and the gear shaft 531.

Further, in the present embodiment, the gear shaft 531 is a portion of the electrode 53. However, a gear shaft may be provided independent of a power supply path to the electrode 53. For example, the casing 10 may have a through-hole extending through the second end surface 12 in the first direction, and may include a cap attached to the through-hole. For example, the through-hole is configured to allow developing agent to be supplied therethrough into the casing 10. A gear shaft may extend in the first direction from the cap toward the second gear cover 54. Alternatively, a gear shaft may extend in the first direction from the second gear cover 54 toward the casing 10.

Further, a shape of the detection protrusion 521 is not limited to the shape illustrated in FIG. 4. Further, the detection gear 52 may include a plurality of detection protrusions 521. The numbers of the detection protrusions 521, position and length of each detection protrusion 521 in the circumferential direction, and length of each detection protrusion 521 in a radial direction may be changed depending on the specification of the developing cartridge 1. Various specifications of the developing cartridges 1 can be indicated to the image forming apparatus by making variations in numbers and shapes of the detection protrusion 521.

Further, the detection gear 52 may be configured by a plurality of components. For example, the detection gear 52 and the detection protrusion 521 may be formed separately from each other. Further, the detection gear 52 may include a gear body and an auxiliary member whose position is changeable in accordance with a rotation of the gear body. The auxiliary member may be in contact with the surface of the gear body, and may be pressed by the gear body so as to be moved in a rotational direction of the gear body or in the first direction. Then, the auxiliary member may change the position of the detection lever. Further, the detection gear 52 may include a gear body, a cam rotatable in accordance with rotation of the gear body, and a detection protrusion displaceable in accordance with rotation of the cam.

Further, the detection gear 52 may be a movable gear movable in the first direction upon rotation, and the engagement between the second agitator gear 51 and the detection gear 52 may be shut off in accordance with the movement of the detection gear 52 in the first direction. In this case, a plurality of gear teeth may be provided throughout an entire outer peripheral surface of the detection protrusion 521. The detection gear 52 may be moved in a direction away from the second end surface 12 or in a direction approaching the second end surface 12.

The second gear cover 54 is fixed to the second end surface 12 of the casing 10, for example, by screws. In other words, the second gear cover 54 is positioned at the second end surface 12. The second agitator gear 51, the detection gear 52, and at least a portion of the electrode 53 are accommodated in a space defined between the second end surface 12 and the second gear cover 54. That is, the second agitator gear 51, the detection gear 52, and at least the portion of the electrode 53 are covered by the second gear cover 54. The second gear cover 54 has an opening 541. A portion of the detection protrusion 521 and a portion of the gear shaft 531 are exposed through the opening 541. The detection lever described above can contact the detection gear 52 or the gear shaft 531 through the opening 541.

2. Locking Structure

Next, a structure for locking the developing cartridge 1 relative to the drum cartridge 100 will be described.

Figure 5:
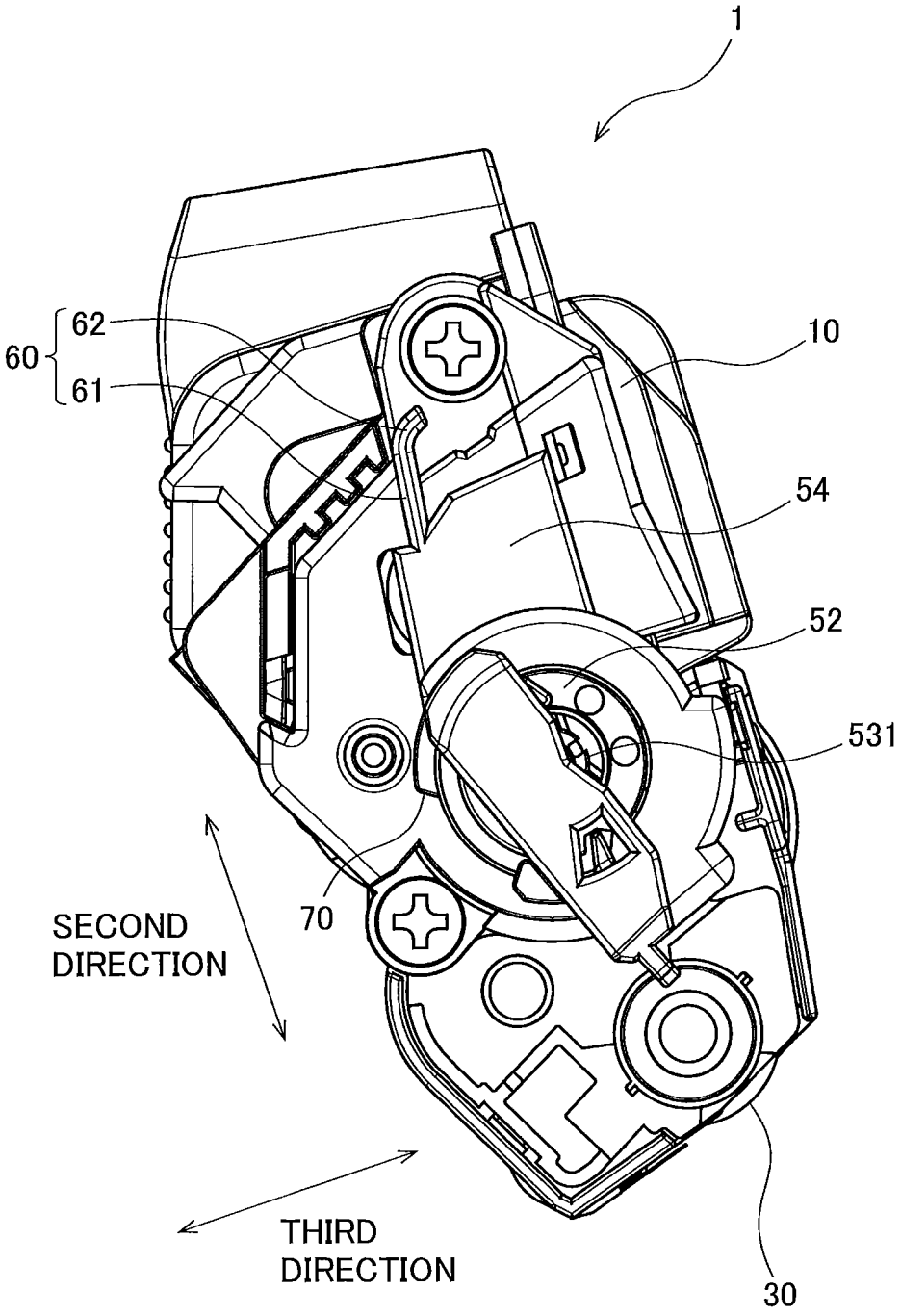
FIG. 5 is a side view of the developing cartridge according to the embodiment.

FIG. 5 is a side view of the developing cartridge 1 as viewed from another side (i.e., the second gear cover 54 side) in the first direction of the developing cartridge 1. As illustrated in FIG. 5, the second gear cover 54 includes a lock rib 60 and has a lift surface 70.

The lock rib 60 is configured to be locked to one end of a lock lever 110 (described later) of the drum cartridge 100 in a state where the developing cartridge 1 is attached to the drum cartridge 100. The lock rib 60 protrudes in the first direction from the second gear cover 54. The lock rib 60 includes a flat plate portion 61 and a curved portion 62. The flat plate portion 61 extends in the second direction and having one end in the second direction. The curved portion 62 is curved from the one end of the flat plate portion 61 toward a third direction crossing the first direction and the second direction. The lock rib 60 is positioned opposite to the developing roller 30 with respect to the detection gear 52 in the second direction. That is, the detection gear 52 is positioned between the developing roller 30 and the lock rib 60 in the second direction. In the present embodiment, the lock rib 60 is positioned at a position overlapped with the agitator 20 in the first direction.

The lift surface 70 is configured to be pressed by another end of the lock lever 110 of the drum cartridge 100 in a case where the developing cartridge 1 is detached from the drum cartridge 100. The lift surface 70 constitutes a portion of an outer surface of the second gear cover 54, and extends in the first direction. The lift surface 70 is positioned between the lock rib 60 and the developing roller 30 in the second direction.

Figure 6:
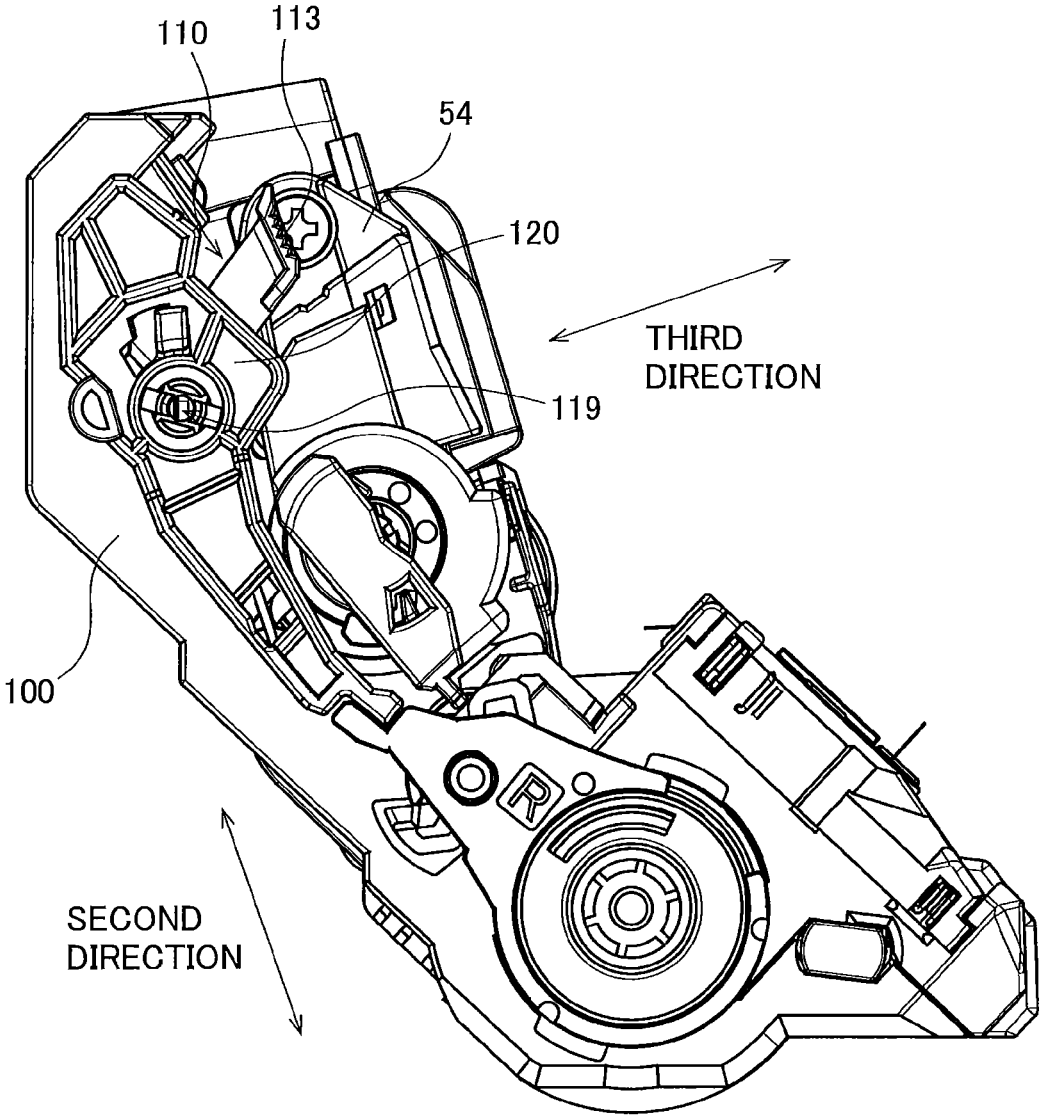
FIG. 6 is a side view of the drum cartridge to which the developing cartridge according to the embodiment has been attached.

FIG. 6 is a side view of the drum cartridge 100 to which the developing cartridge 1 is attached as viewed from the other side (i.e., the second gear cover 54 side) in the first direction. As illustrated in FIG. 6, the drum cartridge 100 includes the lock lever 110.

The lock lever 110 is configured to lock the developing cartridge 1 relative to the drum cartridge 100. The lock lever 110 is pivotally movable about a pivot shaft 119 extending in the first direction.

Figure 7:
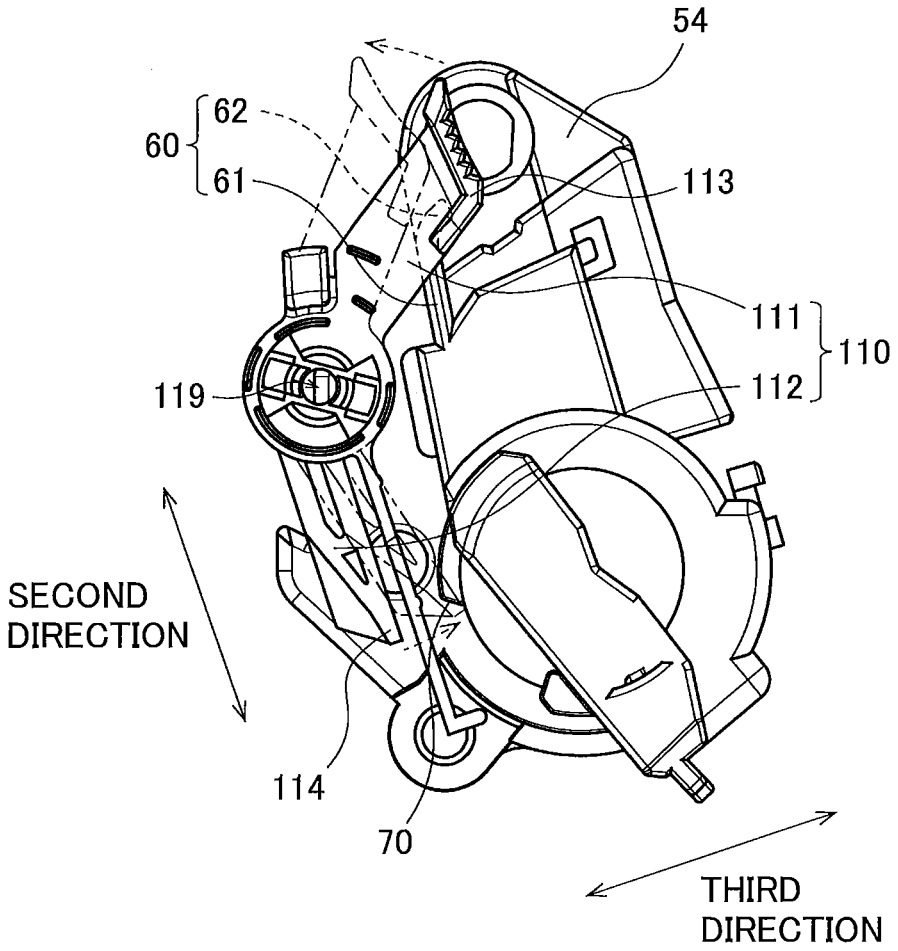
FIG. 7 is a side view of a second gear cover of the developing cartridge according to the embodiment and a lock lever of the drum cartridge.

FIG. 7 is a side view of only the second gear cover 54 and the lock lever 110 as viewed from the other side (i.e., the second gear cover 54 side) in the first direction. As illustrated in FIG. 7, the lock lever 110 includes a first arm 111 and a second arm 112. The first arm 111 extends in a radial direction of the pivot shaft 119. The second arm 112 also extends in a radial direction of the pivot shaft 119. An extending direction of the second arm 112 is different from an extending direction of the first arm 111. The lock lever 110 is urged in a circumferential direction about the pivot shaft 119 by an elastic member (not illustrated) such as a torsion spring. More specifically, the lock lever 110 is urged from a lift position as indicated by a two dotted chain line in FIG. 7 to a lock position as indicated by a solid line in FIG. 7.

The first arm 111 has a distal end portion including an operating portion 113. The operating portion 113 extends in the first direction from the distal end portion of the first arm 111. The second arm 112 has a distal end portion including a lift contact portion 114. The lift contact portion 114 is brought into contact with the lift surface 70 in a state where the lock lever 110 is positioned at the lift position.

The process of attachment of the developing cartridge 1 to the drum cartridge 100 is described. For attaching the developing cartridge 1 to the drum cartridge 100, first, the operating portion 113 is pressed by the lock rib 60. Accordingly, the lock lever 110 is temporarily pivotally moved toward the lift position as indicated by a broken line arrow in FIG. 7 against the urging force of the elastic member. Thereafter, the lock lever 110 is again positioned at the lock position because of the urging force of the elastic member after the lock rib 60 moves past the operating portion 113. As a result, the curved portion 62 of the lock rib 60 is locked to the operating portion 113 of the lock lever 110. More specifically, the curved portion 62 is positioned between the pivot shaft 119 of the lock lever 110 and the operating portion 113. The operating portion 113 and the curved portion 62 are in contact with each other in the third direction or face each other with a minute gap therebetween in the third direction, thereby preventing the developing cartridge 1 from being unintentionally detached from the drum cartridge 100.

The process of detachment of the developing cartridge 1 from the drum cartridge 100 is described. For detaching the developing cartridge 1 from the drum cartridge 100, a user pushes the operating portion 113 of the lock lever 100 in the third direction. Therefore, the lock lever 110 is pivotally moved about the pivot shaft 119 in a direction indicated by the broken line arrow in FIG. 7, so that the lock lever 110 is positioned at the lift position as indicated by the two dotted chain line in FIG. 7. Accordingly, the operating portion 113 is disengaged from the curved portion 62 of the lock rib 60. Further, the lift contact portion 114 of the lock lever 110 is brought into contact with the lift surface 70 to press lift surface 70. As a result, the developing cartridge 1 is moved away from the drum cartridge 100 in the third direction, whereby the developing cartridge 1 is detached from the drum cartridge 100.

In this developing cartridge 1, the coupling 41 to which driving force from the image forming apparatus is applied and the lock rib 60 used for attaching the developing cartridge 1 to the drum cartridge 100 are positioned opposite to each other in the first direction with respect to the casing 10. In other words, the coupling 41 and the lock rib 60 are positioned distributively at both ends of the casing 10 in the first direction. Therefore, a space at each end of the casing 10 can be effectively utilized.

Further, the engagement between lock rib 60 and the lock lever 110 can be maintained, even if the developing cartridge 1 is displaced toward the other side in the first direction of the developing cartridge 1 due to the driving force applied to the coupling 41 from the drive shaft. Accordingly, unintentional detachment of the developing cartridge 1 from the drum cartridge 100 can be reliably prevented.

Particularly in the present embodiment, the coupling 41, the coupling gear 42, and the first agitator gear 43 are positioned at the one end of the casing 10 in the first direction, whereas the second agitator 51, the detection gear 52, the electrode 53, the lock rib 60, and the lift surface 70 are disposed at the other end of the casing 10 in the first direction. In other words, these components are positioned distributively at both ends of the casing 10 in the first direction, thereby effectively utilizing the space at each end of the casing 10.

Further, as illustrated in FIG. 6, the drum cartridge 100 includes a wall portion 120 positioned adjacent to the lock lever 110 in the first direction. That is, the wall portion 120 and the lock lever 110 are arrayed in the first direction, and no component exists between the wall portion 120 and the lock lever 110. In the state where the developing cartridge 1 is attached to the drum cartridge 100, the lock lever 110 is positioned between the second gear cover 54 and the wall portion 120 in the first direction. The wall portion 120 restrains the lock lever 110 from being displaced in the first direction. Accordingly, breakdown of the lock lever 110 or breakaway of the lock lever 110 from the drum cartridge 100 can be prevented even if external force directing in the first direction is applied to the lock lever 110.

Incidentally, the wall portion 120 may have a guide surface configured to guide the developing cartridge 1 during attachment of the developing cartridge 1 to the drum cartridge 100.

3. Modifications

While the description has been made in detail with reference to the embodiment(s) thereof, it would be apparent to those skilled in the art that many modifications and variations may be made therein without departing from the spirit of the disclosure. In the following description, various modifications will be described while indicating differences between each modification and the above-described embodiment.

Figure 8:
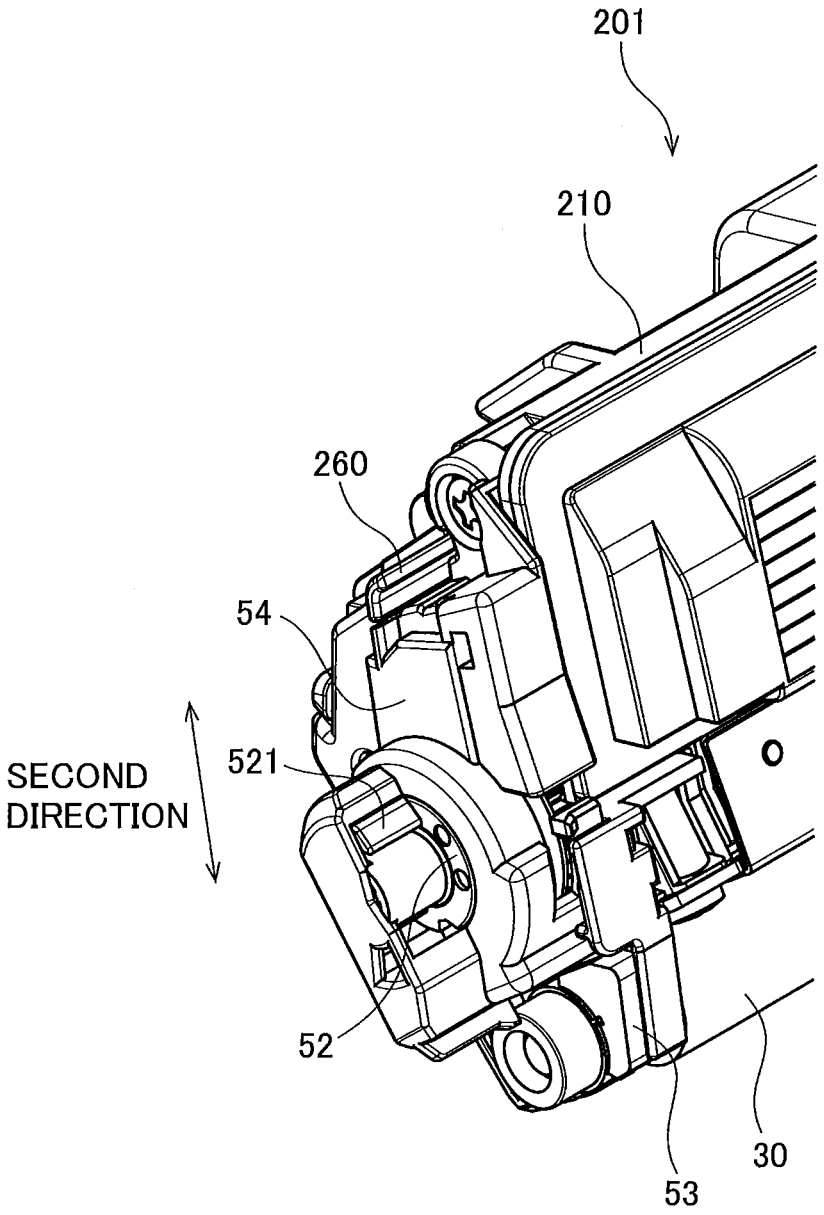
FIG. 8 is a partial perspective view of a developing cartridge according to a first modification.

FIG. 8 is a partial perspective view of a developing cartridge 201 according to a first modification, wherein like parts and components are designated by the same reference numerals as those shown in FIGS. 1 through 7. According to the above-described embodiment, the lock rib 60 protrudes from the second gear cover 54. In contrast, according to the first modification, a lock rib 260 protrudes from a casing 210 in the first direction. This structure also enables the lock rib 260 to be locked to the operating portion 113 of the lock lever 110.

Figure 9:
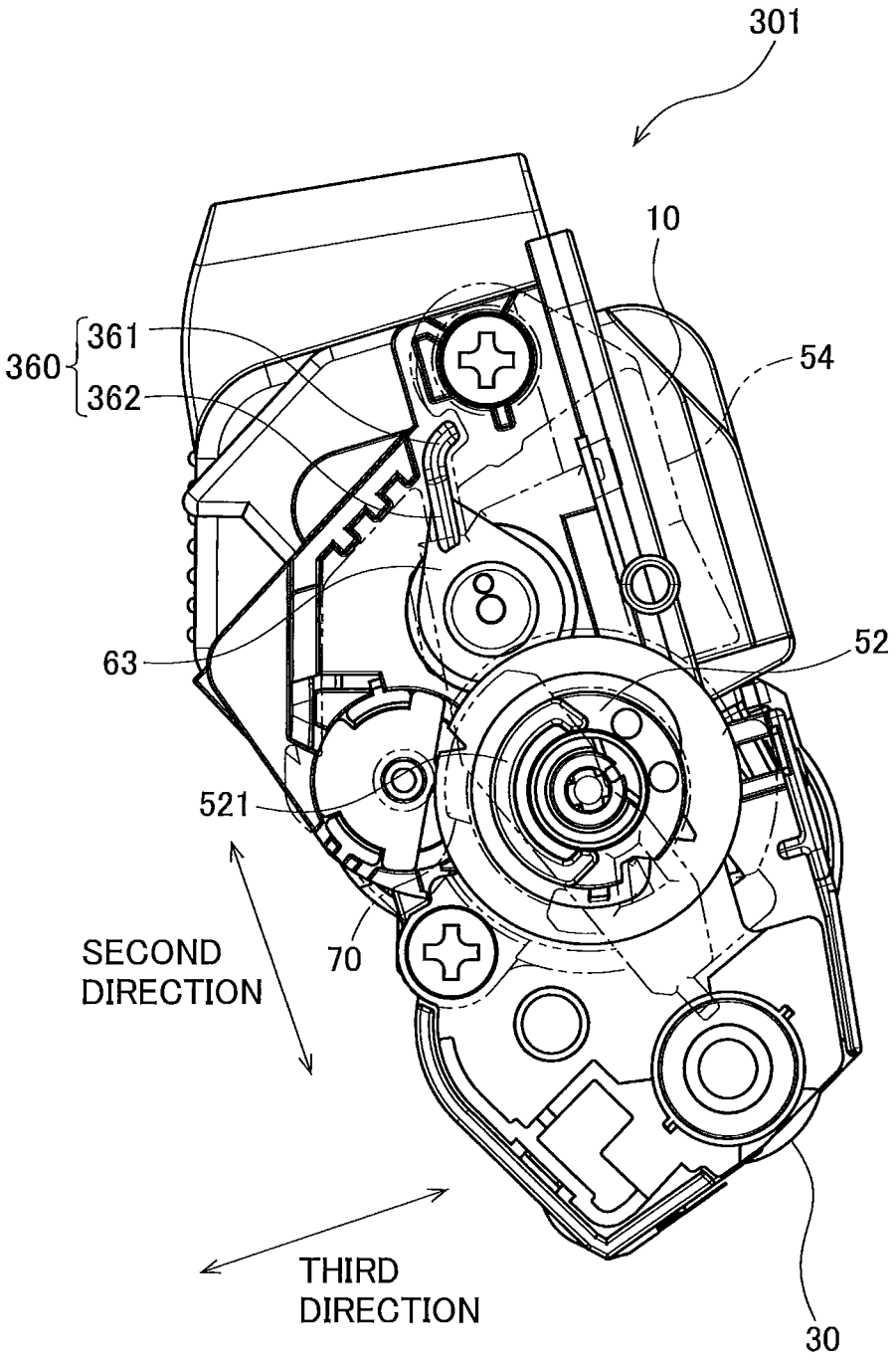
FIG. 9 is a side view of a developing cartridge according to a second modification.

FIG. 9 is a side view of the developing cartridge 301 according to a second modification wherein like parts and components are designated by the same reference numerals as those shown in FIGS. 1 through 7. In the second modification, an auxiliary member 63 is interposed between the casing 10 and the second gear cover 54 that is indicated by a two dotted chain line. The auxiliary member 63 is plate shaped extending perpendicularly to the first direction, and is fixed to the casing 10 or the second gear cover 54, for example, by screws. The auxiliary member 63 includes a lock rib 360 having a flat plate portion 361 and a curved portion 362. This structure also enables the lock rib 360 to be locked to the lock lever 110.

In view of the above-described embodiment, the first modification and the second modification, the lock rib 60 can protrude from either one of the second gear cover 54 and the casing 10. Alternatively, the lock rib 60 may protrude from a component other than the second gear cover 54 and the casing 10.

Figure 10:
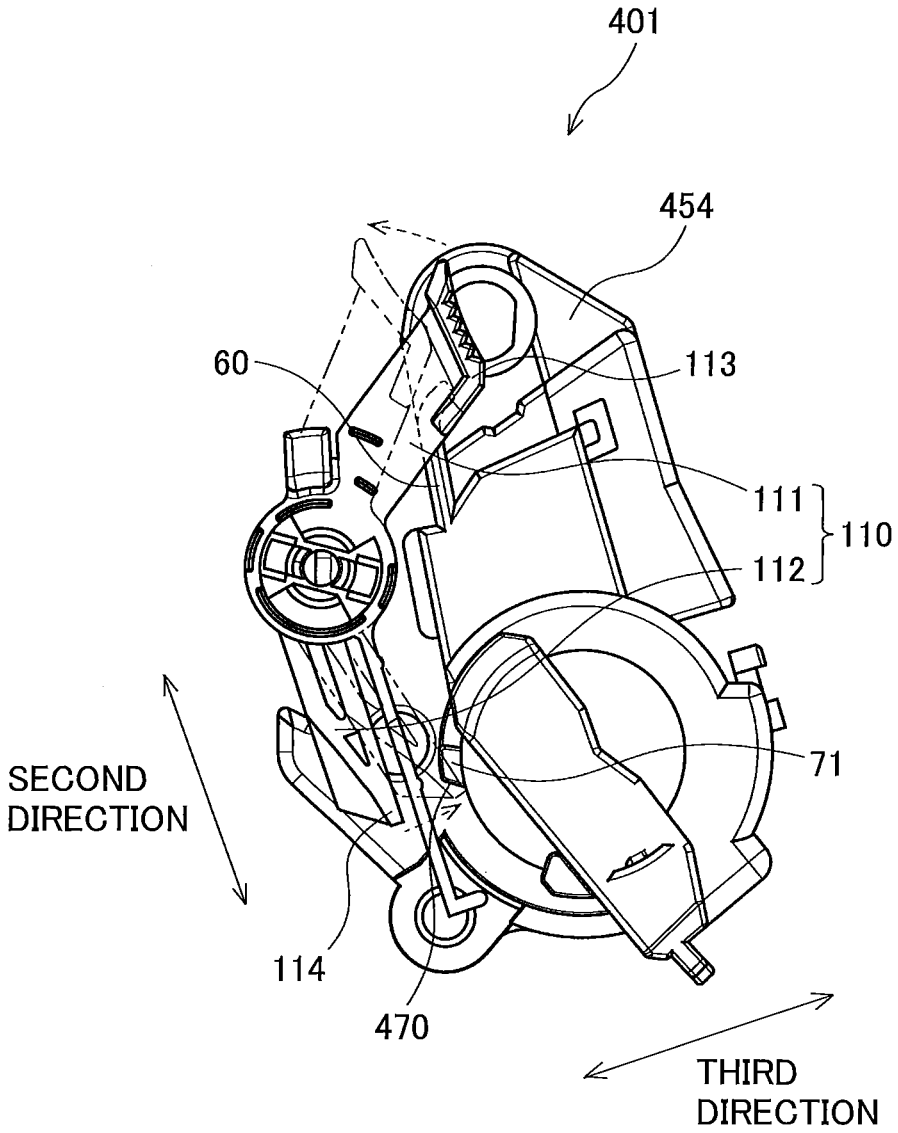
FIG. 10 is a side view of a second gear cover of a developing cartridge according to a third modification and the lock lever of the drum cartridge.

FIG. 10 is a side view of a developing cartridge 401 according to a third modification wherein like parts and components are designated by the same reference numerals as those shown in FIGS. 1 through 7. FIG. 10 particularly illustrates a second gear cover 454 and the lock lever 110. In the third modification, the second gear cover 454 includes a lift rib 71. The lift rib 71 protrudes from the second gear cover 454 in the first direction, and has a lift surface 470. This structure allows the lift contact portion 114 of the lock lever 110 to contact the lift surface 470.

Incidentally, the lift rib 71 may protrude from the casing 10 in the same way as the lock rib 260. Alternatively, the lift rib 71 may protrude from a component other than the second gear cover 54 and the casing 10.

Figure 11:
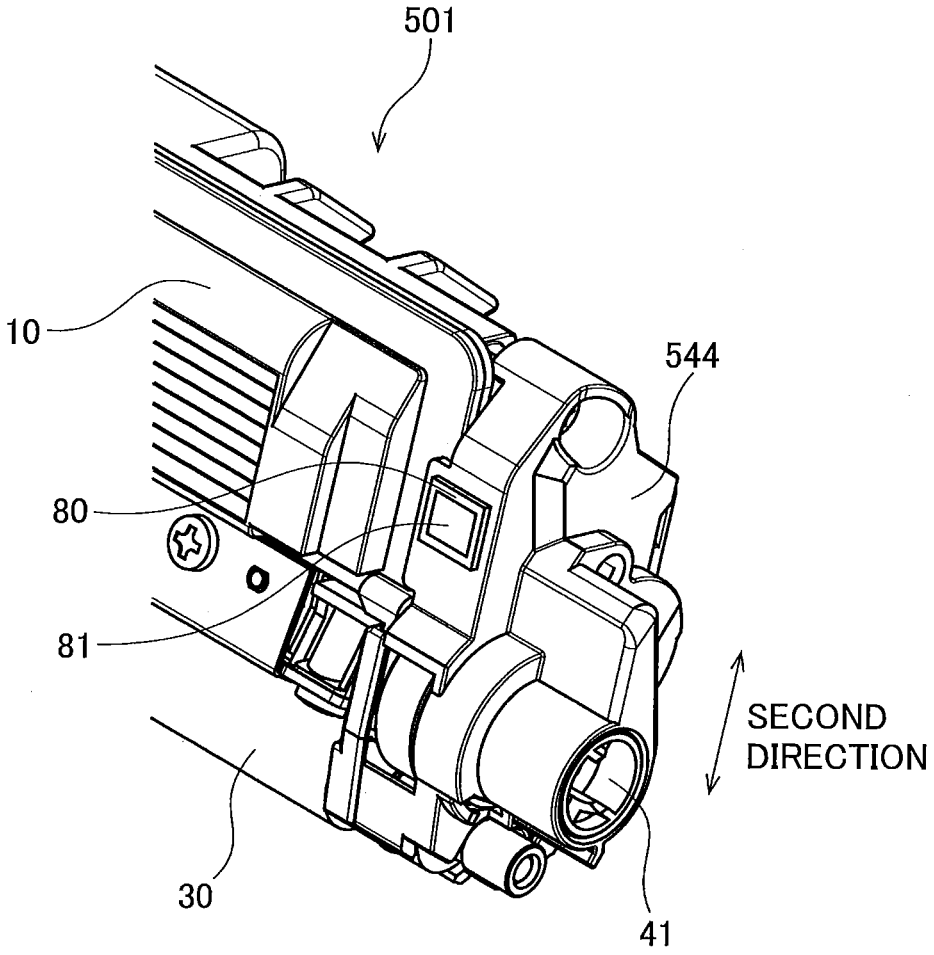
FIG. 11 is a partial perspective view of a developing cartridge according to a fourth modification.

FIG. 11 is a partial perspective view of a developing cartridge 501 according to a fourth modification wherein like parts and components are designated by the same reference numerals as those shown in FIGS. 1 through 7. The developing cartridge 501 includes an IC chip 80. The IC chip 80 is an example of a storage medium configured to store various information relating to the developing cartridge 501. The IC chip 80 is fixed to an outer surface of a first gear cover 544, and includes an electrical contact surface 81 formed of electrically conductive material such as metal. That is, the electrical contact surface 81 is supported to the outer surface of the first gear cover 544. The electrical contact surface 81 is positioned opposite to the developing roller 30 with respect to the coupling 41. The electrical contact surface 81 is brought into contact with a terminal provided in the image forming apparatus when the drum cartridge 100 to which the developing cartridge 501 is attached is accommodated in the image forming apparatus.

Figure 12:
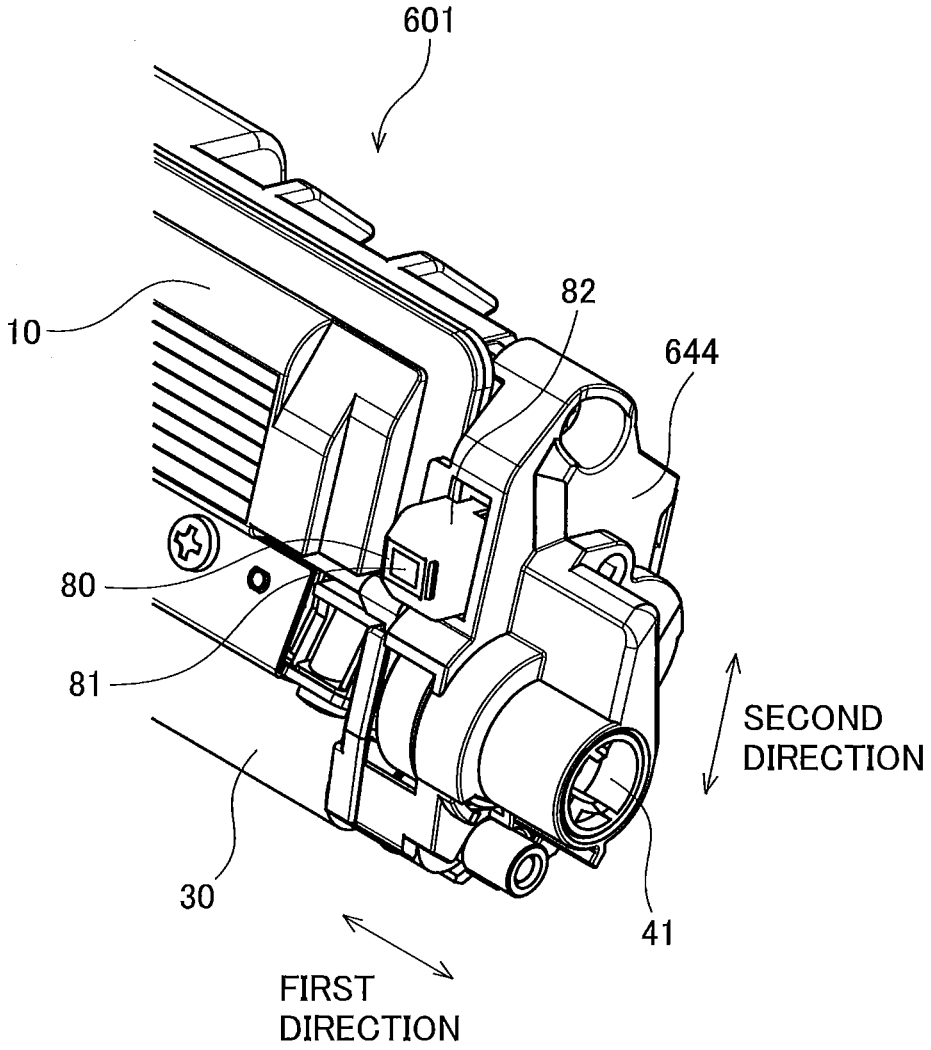
FIG. 12 is a partial perspective view of a developing cartridge according to a fifth modification.

FIG. 12 is a partial perspective view of a developing cartridge 601 according to a fifth modification wherein like parts and components are designated by the same reference numerals as those shown in FIGS. 1 through 7. The developing cartridge 601 includes a holder 82 holding an IC chip 80. The holder 82 is supported to a first gear cover 644 such that the holder 82 is movable relative to the first gear cover 644 in a direction crossing the first direction. The movable IC chip 80 can restrain frictional wearing of the electrical contact surface 81 relative to the terminal of the image forming apparatus.

According to the fourth and fifth modifications, the electrical contact surface 81 is positioned at one end of the casing 10 in the first direction. That is, the coupling 41, the coupling gear 42, the first agitator gear 43, and the electrical contact surface 81 are positioned at the one end of the casing 10 in the first direction, and the second agitator gear 51, the detection gear 52, the electrode 53, the lock rib 60, and the lift surface 70 are positioned at the other end of the casing 10 in the first direction. Because these components are positioned distributively at both ends of the casing 10 in the first direction, each space at each end of the casing 10 can be effectively utilized.

Particularly, in the fourth and fifth modifications, the electrical contact surface 81 and the electrode 53 are positioned opposite to each other with respect to the casing 10 in the first direction. Thus, the electrical contact surface 81 and the electrode 53 are arranged to be spaced apart from each other, thereby preventing electrical short-circuiting between the electrical contact surface 81 and the electrode 53.

Incidentally, a chip body containing a memory in the IC chip 80 and the electrical contact surface 81 of the IC chip 80 can be positioned at different positions. For example, only the electrical contact surface 81 may be positioned at a position of the IC chip 80 illustrated in FIGS. 11 and 12, and the chip body may be positioned in the developing cartridge at a position different from the position of the electrical contact surface 81.

Further, in the above-described embodiment, the plurality of gears in the first gear portion 40 and the plurality of gears in the second gear portion 50 are in meshing engagement with each other. However, engagement with frictional force is available instead of the meshing engagement. For example, friction member such as rubber may be provided at each of outer circumferential surfaces of the two gear portions, instead of the plurality of gear teeth.

Further, each component used in the developing cartridge may have shape or profile different from that in the above-described embodiment. Further, various features appearing in the above-described embodiment and the modifications may be suitably combined together avoiding conflicting combination.

What is claimed is:

1. A developing cartridge comprising:

a casing configured to accommodate developing agent;

a developing roller rotatable about a first axis extending in a first direction, the developing roller being positioned at one end portion of the casing in a second direction crossing the first direction;

a coupling positioned at one end of the casing in the first direction and rotatable about a second axis extending in the first direction;

a coupling gear rotatable about the second axis extending in the first direction together with the coupling;

a detection gear positioned at another end of the casing in the first direction, the detection gear being rotatable about a third axis extending in the first direction;

an agitator configured to agitate developing agent in the casing and configured to perform power transmission from the coupling gear to the detection gear;

a first gear cover covering at least the coupling gear;

a second gear cover covering at least a portion of the detection gear; and a lock rib positioned at the another end of the casing in the first direction and positioned opposite to the developing roller with respect to the detection gear in the second direction, the lock rib being configured to be locked to a portion of a drum cartridge in a state where the developing cartridge is attached to the drum cartridge.

2. The developing cartridge according to claim 1, wherein the lock rib protrudes from the second gear cover.

3. The developing cartridge according to claim 1, wherein the lock rib protrudes from the casing.

4. The developing cartridge according to claim 1, wherein the lock rib extends in the second direction.

5. The developing cartridge according to claim 1, further comprising:

a lift surface positioned at the another end of the casing in the first direction at a position between the lock rib and the developing roller in the second direction, the lift surface being configured to be pressed by a portion of the drum cartridge in a case where the developing cartridge is detached from the drum cartridge.

6. The developing cartridge according to claim 1, further comprising:

a storage medium having an electrical contact surface, the electrical contact surface being positioned at the one end of the casing in the first direction, the electrical contact surface being positioned opposite to the developing roller with respect to the coupling.

7. The developing cartridge according to claim 6, wherein the electrical contact surface is supported to the first gear cover.

8. The developing cartridge according to claim 7, wherein the electrical contact surface is fixed to the first gear cover.

9. The developing cartridge according to claim 7, wherein the electrical contact surface is movable relative to the first gear cover in a direction crossing the first direction.

10. The developing cartridge according to claim 6, further comprising:

an electrode positioned at the another end of the casing in the first direction, the electrode being configured to be electrically connected to the developing roller.

11. The developing cartridge according to claim 10, wherein the electrode includes a shaft protruding in the first direction, and wherein the detection gear is rotatable about the shaft.

12. The developing cartridge according to claim 1, wherein the second gear cover includes a shaft protruding in the first direction, and wherein the detection gear is rotatable about the shaft.

13. The developing cartridge according to claim 1, wherein the detection gear is configured to be disconnected from the agitator such that the power transmission through the agitator to the detection gear is shut off as a result of rotation of the detection gear by a predetermined angle.

14. The developing cartridge according to claim 1, wherein the agitator is rotatable about a fourth axis extending in the first direction, the developing cartridge further comprising:

a first agitator gear positioned at the one end of the casing in the first direction and rotatable about the fourth axis extending in the first direction together with the agitator, the first agitator gear being meshingly engaged with the coupling gear; and a second agitator gear positioned at the another end of the casing in the first direction and rotatable about the fourth axis extending in the first direction together with the agitator, the second agitator gear being meshingly engageable with the detection gear.

* * * * *